US008551255B2

(12) United States Patent
Hedstrom et al.

(10) Patent No.: US 8,551,255 B2
(45) Date of Patent: Oct. 8, 2013

(54) RAPID HEAT SYSTEM FOR A MULTI-TUB DISHWASHER

(75) Inventors: Kristen K. Hedstrom, Orlando, FL (US); Mark E. Palm, Orlando, FL (US); Rodney M. Welch, Jackson, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 2385 days.

(21) Appl. No.: 11/052,886

(22) Filed: Feb. 9, 2005

(65) Prior Publication Data

US 2006/0174915 A1 Aug. 10, 2006

(51) Int. Cl.
*B08B 7/04* (2006.01)

(52) U.S. Cl.
USPC ..... 134/18; 134/25.2

(58) Field of Classification Search
None
See application file for complete search history.

(56) References Cited

U.S. PATENT DOCUMENTS

| | | | | |
|---|---|---|---|---|
| 3,997,760 | A * | 12/1976 | Salinger | 392/501 |
| 5,470,142 | A | 11/1995 | Sargeant et al. | |
| 5,651,380 | A | 7/1997 | Sargeant et al. | |
| 5,651,382 | A | 7/1997 | Sargeant et al. | |
| 5,709,237 | A | 1/1998 | Sargeant et al. | |
| 5,743,281 | A | 4/1998 | Sargeant et al. | |
| 5,755,244 | A | 5/1998 | Sargeant et al. | |
| 6,189,551 | B1 | 2/2001 | Sargeant et al. | |
| 6,244,277 | B1 | 6/2001 | Maunsell | |
| 6,260,565 | B1 | 7/2001 | Welch et al. | |
| 6,294,767 | B1 | 9/2001 | Sargeant et al. | |
| 6,398,495 | B1 | 6/2002 | Kazianus | |
| 6,447,081 | B1 | 9/2002 | Sargeant et al. | |
| 6,460,555 | B1 | 10/2002 | Tuller et al. | |
| 6,491,049 | B1 | 12/2002 | Tuller et al. | |
| 2003/0084928 | A1 | 5/2003 | Wood | |

FOREIGN PATENT DOCUMENTS

| | | | |
|---|---|---|---|
| DE | 3337369 | | 4/1985 |
| DE | 4238450 | | 5/1994 |
| JP | 64-5521 | * | 1/1989 |

* cited by examiner

*Primary Examiner* — Eric Golightly
(74) *Attorney, Agent, or Firm* — Jacquelyn R. Lin; Diederiks & Whitelaw PLC

(57) ABSTRACT

A dishwasher includes a first washing chamber and a second washing chamber capable of performing a washing operation separately and/or concurrently. Each washing chamber includes a wash pump, a drain pump and a heating unit that are operatively connected to a controller. When initiating a washing fluid in one washing chamber, the controller determines if the other washing chamber is active. If the other washing chamber is active, the heating unit for the one washing chamber is operated at a low power level. However, if the other washing chamber is inactive, the one washing chamber is operated at a high power level to rapidly heat the washing fluid and thus shorten the duration of the washing operation.

5 Claims, 4 Drawing Sheets

RAPID HEAT SYSTEM FOR A MULTI-TUB DISHWASHER

BACKGROUND OF THE INVENTION

1. Field of the Invention

The present invention pertains to the art of dishwashers and, more particularly, to a rapid heat system for a multi-tub type dishwasher that diverts power from an inactive washing tub to an active washing tub so as to rapidly heat washing fluid in the active washing tub.

2. Discussion of the Prior Art

In general, various types of dishwashers are known in the art. One type of dishwasher which is experiencing increased popularity is a drawer-type dishwasher. Typically, a drawer-type dishwasher includes a drawer or pull-out washing tub slidably mounted in a cabinet. A dish rack is provided within the washing tub to support dishware and other items during a washing operation. In some cases, the dishwasher will include first and second drawers or washing tubs arranged in an upper and lower configuration. A washing operation can be performed in either one, the other, or both of the washing tubs. That is, the first and second washing tubs are capable of performing washing operations individually or simultaneously.

Most household dishwashers are powered by a dedicated, generally, 15-20 amp supply circuit. When both the first and second washing tubs are operating simultaneously, power must be shared so the supply circuit is not overloaded. Generally, sharing power between the first and second washing tubs does not pose any problems. Wash pumps, drain pumps and other control elements do not, in most cases, have high power requirements. However, heating units employed to heat a washing fluid do possess high power requirements.

Given that the first and second washing tubs are capable of operating both individually and simultaneously, the first and second washing tubs include corresponding first and second heating units. Thus, in order to ensure that the supply circuit is not overloaded, the combined current draw of both the first and second heating units cannot exceed a current rating of the supply circuit. With this configuration, the ability to quickly heat washing fluid in either the first and/or second washing tubs is limited. That is, even if only one of the first and second washing tubs is operating or active, the heating element must still operate at a relatively low power level.

Based on the above, there exists a need in the art for a system to rapidly heat washing fluid in a drawer-type dishwasher. More specifically, there exists a need for a system that can direct power to rapidly heat one washing tub of a two drawer dishwasher if the other washing tub is inactive.

SUMMARY OF THE INVENTION

The present invention is directed to a dishwasher including a first washing tub, preferably defined by a first drawer, and a second washing tub, preferably defined by a second drawer. The dishwasher is capable of performing a washing operation in each of the first and second washing tubs separately and/or simultaneously. Toward that end, the first and second washing tubs have associated wash pumps and drain pumps, but preferably a common controller. In addition, the dishwasher includes first and second heating units associated with the first and second washing tubs respectively. More specifically, each of the first and second heating units is operable at multiple heating levels so as to heat washing fluid during select portions of a washing operation. The controller is operatively connected to each of the first and second heating units, as well as each wash pump and drain pump.

In accordance with a preferred embodiment of the present invention, prior to activating the first heating unit to heat washing fluid in the first washing tub, the controller determines whether the second washing tub is active. A washing tub can be defined as being active if, for example, a washing operation is underway or if its associated heating unit is being powered. In any event, if the second washing tub is active, the controller will establish a low power level requirement and operate the first heating unit, i.e., the heating unit associated with the first washing tub, at a low or normal power level. On the other hand, if the second washing tub is inactive, the controller will establish a high power level requirement and operate the first heating unit at a high power level so as to rapidly heat the washing fluid and, thus shorten the washing operation.

In accordance with one aspect of the preferred embodiment, each of the first and second heating units is constituted by a dual element heating unit. In this manner, when the controller establishes the low power level requirement for the first heating unit, only one of the dual elements is activated while, for a high power level requirement, both of the dual elements are activated. In accordance with another aspect of the preferred embodiment, each of the first and second heating units is constituted by a high capacity heating element operated by a microprocessor. In this manner, when the controller establishes a low power level requirement, the microprocessor establishes a corresponding low heat setting while, for a high power level requirement, the microprocessor establishes a corresponding high heat setting. In this manner, in the event that only one of the first and second washing tubs is active, the controller will divert power from the inactive washing tub to the active washing tub in order to rapidly heat the washing fluid and shorted the washing operation.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
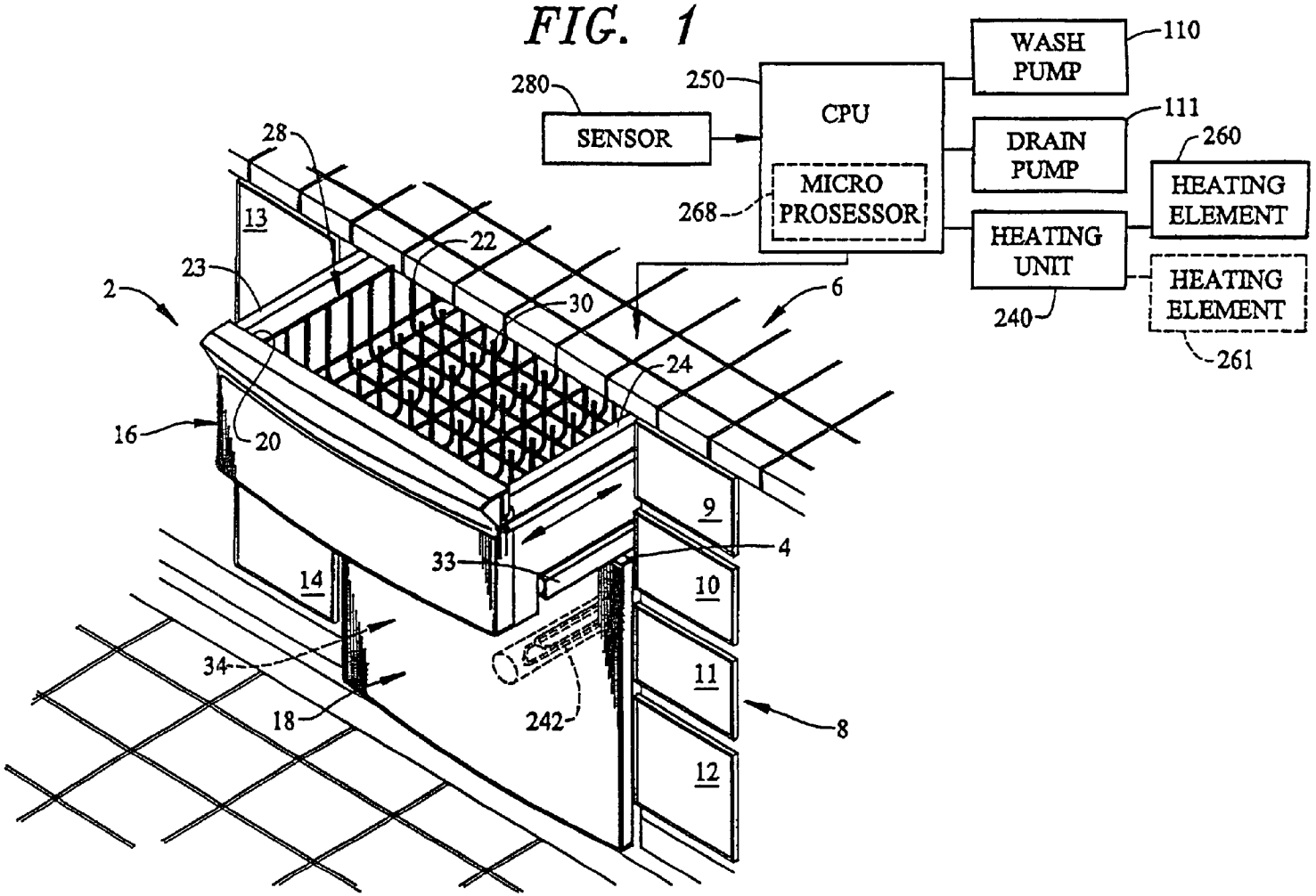
FIG. 1 is an upper right perspective view of a drawer-type dishwasher incorporating a rapid heat system constructed in accordance with the present invention.
Figure 2:
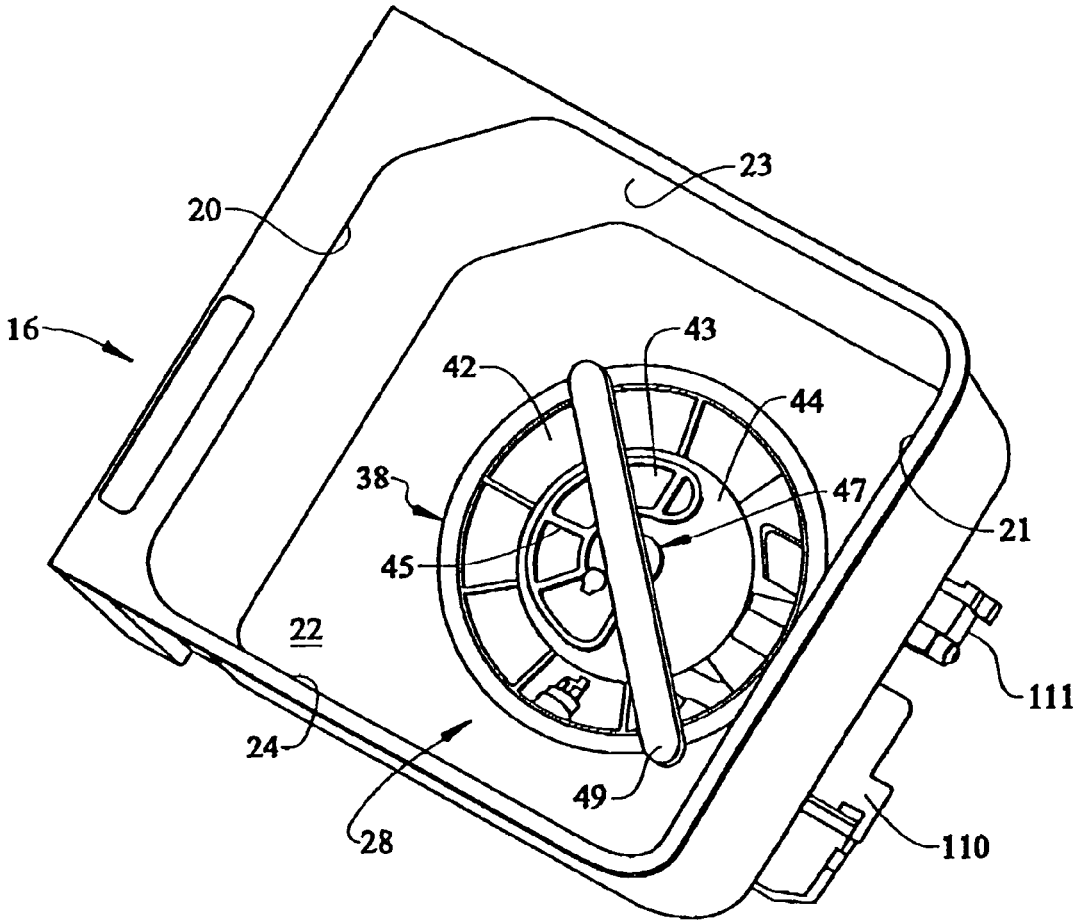
FIG. 2 is an upper perspective view of a wash tub of the dishwasher of FIG. 1.

With initial reference to FIGS. 1 and 2, a dishwasher constructed in accordance with the present invention is generally indicated at 2. As shown, dishwasher 2 includes a support frame 4 arranged below a kitchen countertop 6. Also below kitchen countertop 6 is shown cabinetry 8 including a plurality of drawers 9-12, as well as cabinet doors 13 and 14. In accordance with the invention, dishwasher 2 constitutes a dual cavity dishwasher having an upper washing unit 16 and a lower washing unit 18. As best illustrated in FIG. 1, upper washing unit 16 takes the form of a slide-out drawer unit, having a small or medium capacity, so as to be used for cleaning glassware and the like, while lower cavity 18 is illustrated as a larger capacity drawer for washing larger sized items, such as dinnerware, cookware and the like.

As shown, upper washing unit or drawer 16 includes a front wall 20, a rear wall 21, a bottom wall 22 and opposing side walls 23 and 24 that collectively define a first washing tub or chamber 28. In a manner known in the art, first washing tub 28 is provided with a dish rack 30 for supporting various objects, such as dishware, glassware, and the like, to be exposed to a washing operation. Upper washing unit 16 is slidingly supported within support frame 4 through a pair of extensible drawer support guides, one of which is indicated at 33. In a similar manner, lower washing unit 18 includes front, rear, bottom and opposing side walls (not shown) that collectively define a second washing tub 34.

For the sake of completeness, FIG. 2 illustrates a main filter housing 38 provided on bottom wall 22 within first washing tub 28. Main filter housing 38 is actually positioned within a central, generally U-shaped, intake ring 40 (see FIG. 3) arranged along bottom wall 22. In any event, main filter housing 38 includes an outer or first radial strainer 42, an inner or second radial strainer 43 and a cover 44. Actually, second radial strainer 43 is associated with a fine particle filter chamber including a fine mesh filter screen (not shown) provided within each of a plurality of large openings 45 arranged about cover 44. A hub member 47 is arranged on cover 44 and serves as a support for a wash arm 49. In a manner known in the art, wash arm 49 sprays washing fluid onto kitchenware placed within first washing tub 28 to remove food debris and other soil particles.

Figure 3:
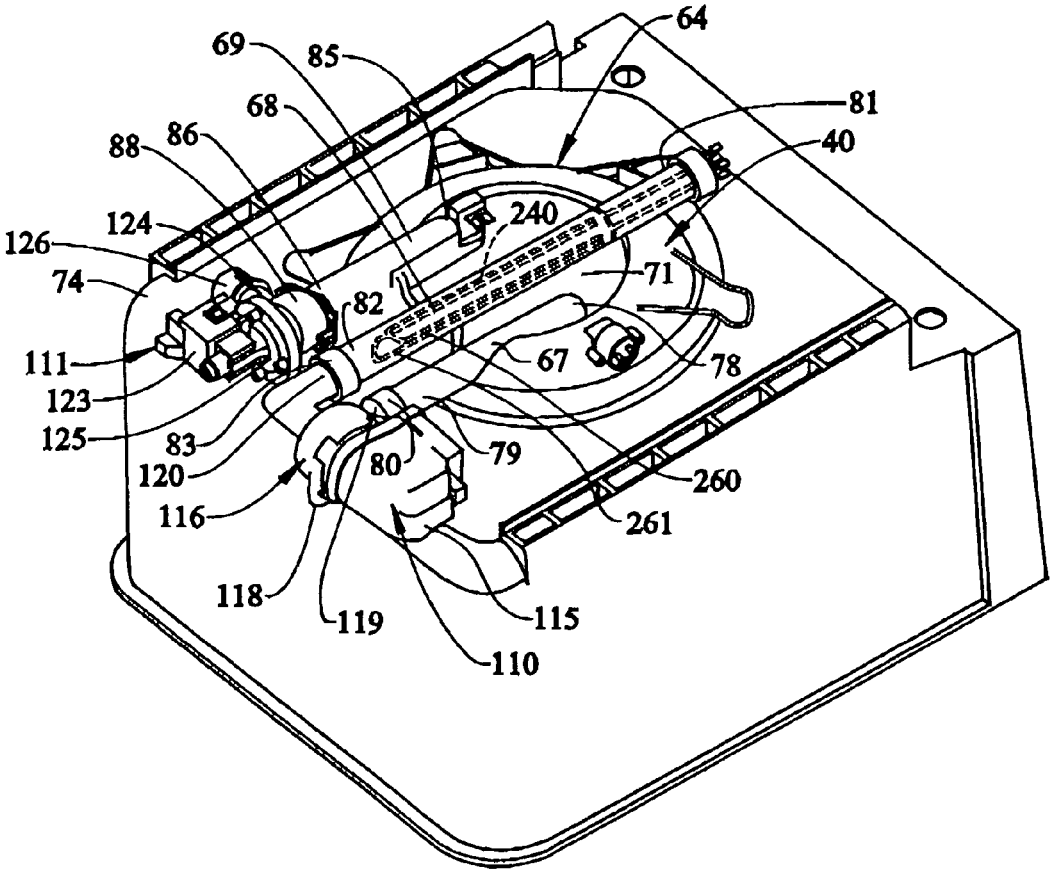
FIG. 3 is a lower perspective view of the wash tub of FIG. 2, illustrating a heating unit assembly constructed in accordance with one aspect of the present invention.

With particular reference to FIG. 3, dishwasher 2 also includes a sump 64 having a plurality of fluid conduits 67-69 extending along bottom wall 22 of first washing tub 28. In the embodiment shown, fluid conduit 67 constitutes a wash fluid supply conduit, fluid conduit 68 constitutes a wash fluid recirculation conduit, and fluid conduit 69 constitutes a wash fluid drain conduit, wherein each of fluid conduits 67-69 provides washing fluid flow management during a washing operation. Preferably, fluid conduits 67-69 are spaced from and arranged substantially parallel to one another across bottom wall 22, with conduits 67 and 69 extending from a central portion 71 of intake ring 40 to an outer edge portion 74 of first washing tub 28. More specifically, supply conduit 67 includes a first end 78, fluidly connected to wash arm 49, that leads to a second end 79. Second end 79 is provided with an attachment flange 80. Likewise, recirculation conduit 68 extends from a first end 81, fluidly exposed to washing tub 28, that leads to a second end 82. In a manner corresponding to supply conduit 67, recirculation conduit 68 is provided with an attachment flange 83. Finally, drain conduit 69 extends from a first end 85 that is in fluid communication with main filter housing 38 to a second end 86 which is also provided with an attachment flange 88.

In addition to managing the flow of washing fluid in dishwasher 2, sump 64 serves as a mounting platform for a plurality of wash system components. As best shown in FIG. 3, a wash pump 110 and a drain pump 111 are mounted to first washing tub 28 along outer edge portion 74. Preferably, wash pump 110 includes a wash motor housing 115 and a wash pump housing 116. More preferably, wash pump housing 116 includes a fresh water inlet 118, a supply outlet 119 for directing washing fluid toward wash arm 49 and a recirculation inlet 120 that conducts wash fluid back from first washing tub 28 into wash pump housing 116 where the wash fluid is once again directed to wash arm 49. Toward that end, supply outlet 119 and recirculation outlet 120 project into attachment flanges 80 and 83 of supply and recirculation conduits 67 and 68 respectively. With this arrangement, a substantially closed loop recirculation system is formed for first washing tub 28. Likewise, drain pump 111 includes a drain motor housing 123 and a drain pump housing 124. Drain pump housing 124 includes an inlet portion 125 and an outlet port 126 adapted to be interconnected to a drain hose (not shown). Inlet portion 125 is preferably provided with a chopping mechanism (not shown) for macerating food particles to be expelled with washing fluid from first washing tub 28 during periodic drain or purging operations.

In accordance with one form of the invention, dishwasher 2 includes a heating unit 240 for heating washing fluid during select portions of a washing operation. In the embodiment shown, heating unit 240 is arranged within recirculation conduit 68 so as to heat the washing fluid flowing from washing tub 28. That is, in accordance with the embodiment shown, wash fluid flowing from first washing tub 28 through recirculation conduit 68 can be heated by selectively activating heating unit 240.

At this point, it should be understood that second washing tub 34 includes structure corresponding to that described above with respect to first washing tub 28, including a corresponding heating unit shown in phantom at 242 in FIG. 1, and is independently controllable. In general, the structure described above has only been described for the sake of completeness. A more detailed description can be found in commonly owned patent application filed on even date herewith, entitled "Multi-Use Sump for a Drawer-Type Dishwasher", and incorporated by reference. Instead, the present invention is particularly directed to the particular control and operation of heating unit 240.

In accordance with the present invention, dishwasher 2 includes a control unit or CPU 250 (see FIG. 1). Control unit 250 is operatively connected between at least wash pump 110, drain pump 111 and heating unit 240. In accordance with one preferred embodiment, heating unit 240 is selectively operable at multiple power or heat levels that are established by control unit 250. As will be detailed more fully below, control unit 250 can establish a low power level setting for heating unit 240 or, alternatively, establish a high power level or rapid heat setting for heating unit 240. Toward that end, heating unit 240 can include one heating element 260 that can be selectively operated at low or high power levels, or first and second heating elements 260 and 261 which can be selectively operated individually or in combination. If heating unit 240 includes only one heating element 260, heating element 260 is preferably constituted by a high capacity heating element controlled through a microprocessor 268 that, in the embodiment shown, is contained within control unit 250. More specifically, high capacity heating element 260 in this embodiment is operable at two rates, i.e., a low power/normal heat setting or a high power/rapid heat setting as particularly established by microprocessor 268. In the second embodiment, to establish a low/normal power level setting, control unit 250 activates first heating element 260, and to establish a high power level, control unit 250 activates both first and second heating elements 260 and 261.

In still further accordance with the invention, dishwasher 2 includes at least one sensor 280 operatively coupled to first and second washing tubs 28 and 30, as well as control unit 250. As will be detailed more fully below, sensor 280, when signaled by control unit 250, determines whether a particular one of first and second washing tubs 28 and 30 is active. Sensor 280 can determine that a particular washing tub 28, 30 is active either by sensing that heating unit 240, associated with the particular washing tub 28, 30 is operating or, alternatively, by sensing whether a washing operation is currently underway in the particular washing tub 28, 30.

Figure 4:
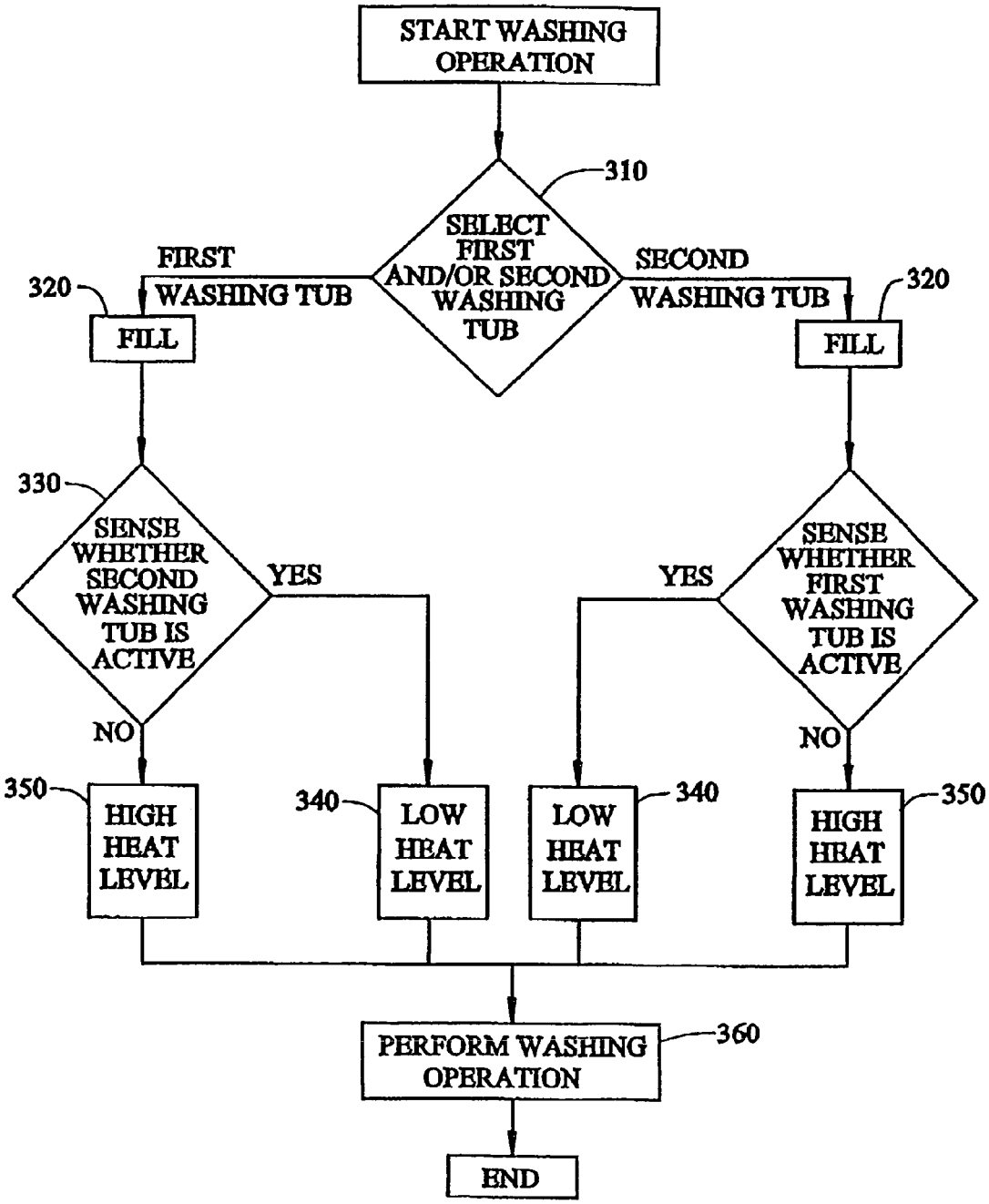
FIG. 4 is a flow diagram illustrating operation of the rapid heat system of the present invention.

Reference will now be made to FIG. 4 in describing a preferred method of operation for dishwasher 2. After loading dishes or the like into first and/or second washing tub 28, 30, a consumer activates one or both of washing tubs 28 and/or 30 through a control element (not shown) as represented at 310. At this point washing fluid begins to enter and fill, for example, first washing tub 28 to a predetermined level as shown at step 320. Once the washing fluid reaches a predetermined level, it is desired to activate wash pump 110 to circulate the washing fluid in first washing tub 28, while activating heating unit 240 to heat the washing fluid. However, in accordance with the invention, prior to activating heating unit 240, control unit 250 polls sensor 280, in step 330, to inquire whether second washing tub 30 is active. If sensor 280 signals control unit 250 that second washing tub 30 is active, heating unit 240 is operated at the low power setting, as represented in step 340, and the washing operation continues regularly. If, on the other hand, sensor 280 signals control unit 250 that second washing tub 30 is inactive, additional power is available so that heating unit 240 can be operated in a high or rapid heat level, as represented in step 350. After establishing the particular heating step 340 or 350 to employ, the washing operation continues to completion as represented in step 360.

Based on the above, if only one of the first and second washing tubs 28 and 30 is activated, washing fluid recirculating in the active washing tub 28, 30 is heated more rapidly than if both washing tubs 28, 30 were operating. Since the washing fluid is brought to temperature in less time than during a regular washing operation when in the rapid heat mode, the time required to complete a washing operation is reduced. Although described with reference to preferred embodiments of the present invention, it should be readily apparent to one of ordinary skill in the art that various changes and/or modifications can be made to the invention without departing from the spirit thereof. For instance, the use of the terms first and second are for exemplary purposes only and should not be construed as limiting. In addition, the sensor could use various other types of indicators other than washing operation and heater activation to determine whether a washing chamber is active. For example, current switch, LED and the like sensors would also provide an indication of the operation of a particular washing tub. In addition, although the most preferred embodiments of the invention are associated with drawer-type dishwashers, the invention is also applicable to other types of dishwashers. Furthermore, the arrangement of the pumps, heating units and the like on the tubs can be readily changed without deterring from the invention. In general, the invention is only intended to be limited by the scope of the following claims.

We claim:

1. In a dishwasher including a first washing chamber, a second washing chamber, a first heating unit and a second heating unit, said first and second heating units being associated with the first and second washing chambers respectively, a method of rapidly heating washing fluid in one of the first and second washing chambers comprising:

pumping washing fluid within the first washing chamber;

sensing whether the second washing chamber is active; and operating the first heating unit at a low heat level to heat the washing fluid in the first washing chamber if the second washing chamber is active or operating the first heating unit at a high heat level if the second washing chamber is inactive to rapidly heat the washing fluid in the first washing chamber, wherein said first heating unit produces more heat when operated at a high level than when operated at a low heat level.

2. The method of claim 1, wherein sensing whether the second washing chamber is active includes determining if the second heating unit is being powered.

3. The method of claim 1, wherein sensing whether the second washing chamber is active includes sensing for an active washing operation.

4. The method of claim 1, wherein the first heating unit includes a single heating element, said single, heating element being operated at the low heat level when the second washing chamber is active and at the high heat level when the second washing chamber is inactive.

5. The method of claim 1, wherein operating the first heating unit at the low heat level includes operating a first heating element of the first heating unit and operating the first heating unit at the high heat level constitutes operating both the first heating element and a second heating element of the first heating unit.

* * * * *